United States Patent [19]

Salerno

[11] Patent Number: 5,046,743

[45] Date of Patent: Sep. 10, 1991

[54] STRATEGY-TYPE SOCCER BOARD GAME

[76] Inventor: John Salerno, 3136 Natchez Ave., San Diego, Calif. 92117

[21] Appl. No.: 570,409

[22] Filed: Aug. 21, 1990

[51] Int. Cl.[5] ..... A63F 3/00

[52] U.S. Cl. ..... 273/247; 273/290

[58] Field of Search ..... 273/247, 259, 94 R, 273/290

[56] References Cited

U.S. PATENT DOCUMENTS

| | | | |
|---|---|---|---|
| 2,049,284 | 7/1936 | Anderson | 273/94 R |

FOREIGN PATENT DOCUMENTS

| | | | |
|---|---|---|---|
| 249376 | 3/1926 | United Kingdom | 273/247 |
| 537265 | 6/1941 | United Kingdom | 273/247 |
| 623463 | 5/1949 | United Kingdom | 273/259 |
| 627951 | 8/1949 | United Kingdom | 273/247 |
| 1147095 | 4/1969 | United Kingdom | 273/247 |
| 1203185 | 8/1970 | United Kingdom | 273/247 |
| 2181961 | 5/1987 | United Kingdom | 273/247 |

*Primary Examiner*—Benjamin Layno

*Attorney, Agent, or Firm*—Brown, Martin, Haller & McClain

[57] ABSTRACT

A strategy-type soccer board game has a plurality of movable playing pieces and a separate soccer ball, all of which may be moved independently of each other or in concert as determined by rolls of the dice. The game is played by two players, each of whom is given nine playing pieces. Each of the playing pieces has a post at its base onto which a ball having a matching slot may be placed when a particular playing piece is carrying or passing the ball. The game board consists of a rectangular playing field with a grid of squares, each square representing one possible move. Surrounding the field are the out-of-bounds areas. At opposing ends of the field are goal lines, a goal net which must be entered to score a goal and a goalie box. In the center of the field is a kick-off circle and a kick-off square from which the team kicking off initiates play. A table of numbers is located on each player's side of the board, indicating the direction of movement possible depending on the numbers rolled on the dice. The roll of the dice provides a number of possible moves depending on how the dice are grouped, the direction indicated on the table and the strategy by the player.

5 Claims, 2 Drawing Sheets

22

| | | | | | |
|---|---|---|---|---|---|
| 1·RF | 2·SF | 3·LF | 4·RB | 5·SB | 6·LB |
| 7·L | 8·SF | 9·LF | 10·R | 11·RF | 12·SB |

STRATEGY-TYPE SOCCER BOARD GAME

BACKGROUND OF THE INVENTION

I. Field of the Invention

The present invention relates to strategy-type games, and more specifically to strategy-type games simulating soccer play.

II. Background Art

Board games which simulate soccer play have been known for some length of time, but have not achieved a level of sophistication sufficient to challenge a player who enjoys strategy and decision-making type games. In addition, these games have not permitted players to control multiple game pieces which are moved independently of each other, yet work in concert toward the common object of scoring a goal. The closest game to this latter point is the popular Fussball, which is a fast-action game involving physically batting a ball between simulated soccer players mounted on a pivoting pole. The disadvantage of the Fussball game is that is does not permit a player time to work out a strategy, rather it is a fast-action, impulse-type game.

SUMMARY OF THE INVENTION

It is an advantage of the present invention to provide a strategy-type soccer board game which has a plurality of movable playing pieces and a separate soccer ball, all of which may be moved independently of each other or in concert as determined by rolls of the dice. The game is played by two players, each of whom is given nine playing pieces, one of which is a goalie, representing their team. Each of the playing pieces has a post at its base onto which a ball having a matching slot may be placed when a particular playing piece is carrying or passing the ball according to the player's selected movement based upon the roll of the dice.

The game board consists of a rectangular playing field with a grid of squares, each square representing one possible move. Surrounding the field are the out-of-bounds areas. At opposing ends of the field are goal lines, a goal net which must be entered to score a goal and a goalie box which is a rectangle located within the playing field adjacent to the goal net. In the center of the field is a kick-off circle and in the center of that circle is a kick-off square from which the team kicking off initiates play.

A table of numbers is located on each player's side of the board, this table indicating the direction of movements possible depending on the numbers rolled on the dice. Based upon correspondence with these numbers and numbers rolled on the dice, the player makes decisions to determine whether he will pass, dribble, tackle or score a goal, among other possibilities.

BRIEF DESCRIPTION OF THE DRAWINGS

A better understanding of the present invention will be provided by consideration of the following detailed description of the preferred embodiment of the present invention, taken in conjunction with the accompanying drawings, in which like reference numerals refer to like parts and in which.

DETAILED DESCRIPTION OF THE PREFERRED EMBODIMENT

Figure 1:
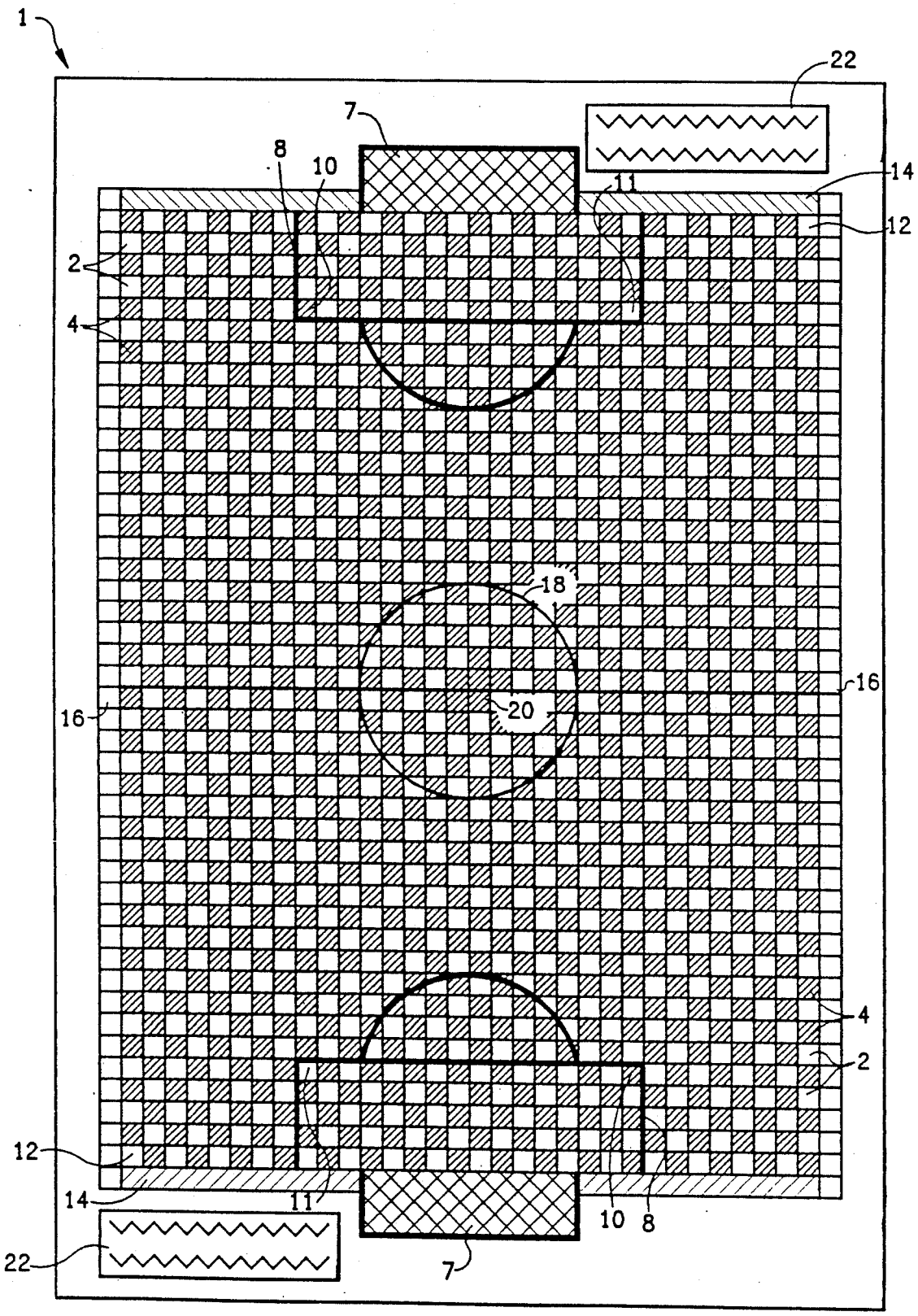
FIG. 1 is a top plan view of a playing board according to the present invention.

The game board 1, as shown in FIG. 1, consists of a grid of light green 2 and dark green 4 squares, 32×44, which makes up the field. At opposite ends of the field are goal nets 6 into which the ball must enter in order to score a goal. In front of the goal net 7 is a smaller rectangular area consisting of 5×16 squares which comprise the goalie box 8. At the two corners of each goalie box farthest from the goal net are goal kick squares 10, 11. In the far corners of the field are corner kick squares 12. At the ends of the field, the goal line 14 is indicated in red. On the sides of the field, the out-of-bounds indicator 16 is yellow.

In the center of the field is a kick-off circle 18 around which players of the opposing teams will be set up in order to initiate play. In the center of the kick-off circle 18 four squares are marked which indicate the kick-off squares 20.

At each player's end of the game board is a table 22 indicating the direction a player or the ball may be moved based upon the numbers rolled on the dice.

Figure 2:
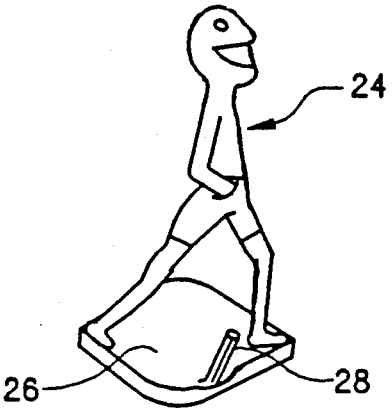
FIG. 2 is a perspective view of a playing piece for use on the game board.
Figure 3:
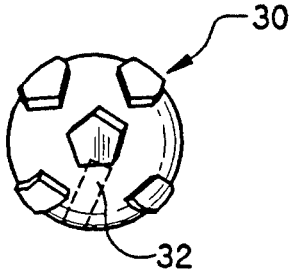
FIG. 3 is a perspective view of the soccer ball according to the invention.
Figure 5:
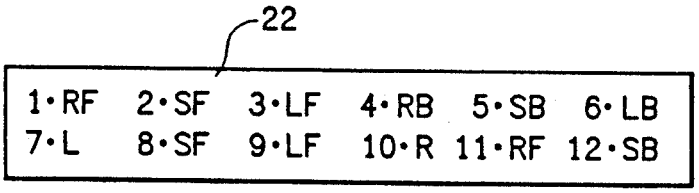
FIG. 5 is a detail view of the table which indicates direction of movement.
Figure 4:
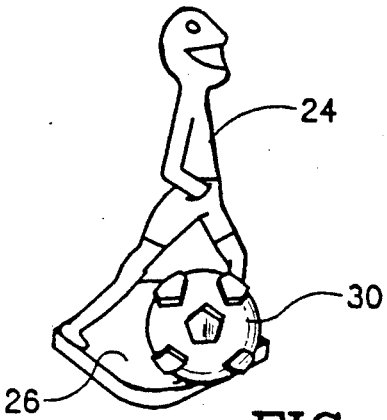
FIG. 4 is a perspective view of a playing piece carrying the soccer ball.

The playing pieces 24, shown in FIG. 2, consist of a character in a running position mounted on the flat base which fits within one of the squares of the playing board. On the base 26 of the playing piece is a post 28 extending upward and slanted outward slightly. When a particular playing piece is in possession of the ball 30, the ball 30, shown in FIG. 3, has a slot 32 which fits over the post 28 and is carried by the playing piece as shown in FIG. 4. Each player has nine playing pieces which will be of a distinctive color so that the two teams can be identified. The goalie for each team is also individually marked for identification, for example, by a striped jersey.

The final essential element for the game is three dice, each of which is a standard cube with faces having marks indicating one to six.

The object of the game is to be the first player to score three goals.

The rules for play are as follows:

POSITIONS: Before the players are positioned, one die is thrown by each player to determine, by the higher score, who will kick off. The team kicking off is called the offense and the other team is called the defense. After the kick-off, whichever team is in possession of the ball 30 is called the offense. Before the start of the game and also before each kick-off (after each goal is scored) the offense positions his playing pieces 24 first, however one playing piece 24 with the ball 30 is reserved for positioning in the kick-off square after the defense has been positioned. The offense positions his playing pieces 24 in the light 2 and dark 4 green squares anywhere on his half of the field (including the inside of his half of the kick-off circle 18). The goalie should, but does not need to, be in or near the goalie box 8.

After the offense is positioned, the defense (the team not kicking off) is allowed to position his players; i.e., the defensive side has the advantage of positioning his players last. The defense may be positioned anywhere on his half of the field, except for any squares completely inside the kick-off circle 18. Defensive playing pieces may be positioned on squares touching the line of the circle 18.

KICK-OFF: After the playing pieces are all positioned, the person awarded the kick-off moves his last playing piece into one of the two kick-off squares 20 on his side of the field. The ball 30 is placed on the post 28 of the playing piece 24 which is about to kick off. The kick-off is taken and is identical to a normal turn as described below.

After the kick-off is completed the defensive player takes an ordinary turn and the rotation continues until a goal is scored. After each goal is scored, the playing pieces are positioned again for another kick-off. The new kick-off is taken by the team which did not score the last goal (now the offensive team). The rules for positioning playing pieces are the same for each kick-off throughout the game, as follows:

Step 1: The offense positions all but one of his playing pieces.

Step 2: The defense positions his playing pieces.

Step 3: The offense positions his last playing piece into one of the two kick-off squares on his half of the field.

The above order gives the defense an opportunity to anticipate the angles of attack and passing opportunities of the offense. It also benefits the offense by not revealing the exact kick-off square.

HOW THE DICE DETERMINE MOVES

DIRECTION OF MOVES: The players and the ball move in straight lines on both the light and dark green squares. The playing piece carrying the ball moves with the ball except during a pass, punt, corner kick, goal kick, free kick or throw-in. A player may not intentionally move out of bounds. Eight possible directions are available. Movement away from a player's starting side, straight towards the opponent's goal is called straight forward. Other options are: Straight back, right, left; and four diagonal directions: Right forward, left forward, left back and right back. Directions are abbreviated on the game board as follows: SF=Straight Forward; SB=Straight Back; R=Right; L=Left; RF=Right Froward; LF=Left Forward; LB=Left Back; RB=Right Back.

NORMAL TURN: A normal turn consists of three dice being thrown. One die or two dice added together are chosen to select a direction according to the chart on the game board. The remaining one or two dice are available for distance. Many moves are possible with any throw of the dice. Several examples are provided at the end of this section.

A normal turn always consists of only one direction (even when two pieces are moved). Any one, or two playing pieces may move in the one direction chosen, depending upon whether one, or two dice added together were used to select a direction. If one die is used to select a direction, then the remaining two dice are used to determine distances. Each distance die must move a playing piece the full numerical value of the die. Both distance values may be applied toward moving a single playing piece, in which case that playing piece must move the complete value of both dice. (If any move would force a playing piece out of bounds, that move must be abandoned and another direction chosen.) No piece may land on any other piece on either team except in a tackle.

If two dice (added together) are used to determine the direction, only one piece may be moved the number of boxes equal to the numerical value of the remaining die.

The numerical value of one die, or two dice added together, determine the direction of travel in straight lines as follows:

| | | | | | |
|---|---|---|---|---|---|
| 1 - RF | 2 - SF | 3 - LF | 4 - RB | 5 - SB | 6 - LB |
| 7 - L | 8 - SF | 9 - LF | 10 - R | 11 - RF | 12 - SB |

This table is located on each player's side of the game board for quick reference.

Example: Dice Thrown=1, 3 and 6

Possible Move: Dice 1 and 3 are added to determine direction 4, which is RB, and one player is moved in the right-back diagonal direction six squares.

Possible Move: Die 1 is used to determine the RF direction and any two pieces are moved in the right forward direction - one piece is moved three squares and another piece is moved six squares.

Possible Move: Die 3 is used to determine direction LF and dice 1 and 6 are added to move one player seven squares, left forward.

Example: Dice Thrown=5, 2 and 1

Possible Move: IF the 1 die determines the direction RF then right forward is the only direction in which pieces may travel. Then either the 5 and the 2 can be added to move one piece seven squares or the 5 can be chosen to move one piece five squares and the 2 used to move another piece two squares in the right forward direction.

Possible Move: The 1 and 2 may be added together to give the direction which is LF and one piece may be moved five spaces in the left forward direction.

REGROUPING: When a team is not set up in an advantageous position, it is possible to correct this by choosing to regroup. Regrouping allows a player to reposition one, two, or even three playing pieces simultaneously to set up a better defense or perhaps prepare for a passing strategy, etc. Regrouping is an available and commonly used option to a normal turn.

The intention to regroup must be announced prior to throwing the dice. Three dice are thrown. Any one playing piece is moved the value, or double the value of one die in any straight line in any one direction. Then either that same piece or another piece is moved the value or double the value of the second die in a straight line in any one direction. Another piece or one of the same pieces is moved in the same manner according to the last die. This constitutes one turn.

Both the offensive team (the team with the ball) and the defensive team may regroup, however the individual piece carrying the ball may never be moved in a "regroup" move. A free ball may never be captured, nor can a ball carrier be tackled when regrouping. The goalie may move during a regrouping move.

Example: If Dice Thrown=3, 5, 2, then

One piece moves any one direction 3 or 6. (Double the 3 for 6.) Then another piece, or the same piece, moves any one direction 5 or 10. Finally, another piece, or one of the above pieces, moves any one direction 2 or 4.

DOUBLING DIE VALUES: Whenever any die value is doubled, the doubled value is considered the "value of the die" and must be used completely. For instance, if a six is doubled to make 12, a player cannot move only eight squares. Exceptions to this are when a goal is scored, or a ball reaches a receiver. Whenever the option to double a die value is available, it is mentioned in the rules.

DRIBBLING: The ball 30, when in possession, is placed on the post 28 of a playing piece 24. The ball is moved with the playing piece whenever that playing piece is moved, exactly like a playing piece not carrying the ball. A playing piece with the ball, or any playing piece, or a free ball, may move over an opponent's piece or over his own piece (except not over an opposing goalie when the goalie is in the goalie box, see GOALKEEPER).

OUT OF BOUNDS: A playing piece cannot simply stop before going out of bounds if the distance die and direction would otherwise take that piece out of bounds. In such a case, a different move must be selected (the only exception is during an ALL FOURS Whistle Blow when a piece is intentionally forced out of bounds).

Although the goalie box is not considered out of bounds, the goalie net itself is considered out of bounds to all players except ball carriers.

TACKLING: Tackling is the most common way to gain possession of the ball. This is accomplished when a defensive player reaches or passes directly over the square of an opposing ball carrier. After completing the move, the player lands on the destination square, removes the ball from the opponent's tackled playing piece, and places the ball on the post of the playing piece which just made the tackle. The tackler is now in possession.

If the tackler should manage to just land exactly on the ball carrier, the old ball carrier is immediately moved by his own team player to any square in a straight line exactly five spaces away from the new ball carrier in any direction (This is called a "standard defensive move".)

PASSING: Any time the ball carrier is in a direct line, vertically, horizontally, or diagonally, with any of his own playing pieces and the sum of all three dice exceeds the number of spaces between them, the ball carrier may pass the ball. This constitutes a complete turn, the ball moves alone and from one player to the other and both players remain in position. During a pass, the ball may pass over as many opposing playing pieces, or your own playing pieces as desired, as long as sufficient distance is available on the dice. A pass may even pass over a goalie, as long as it reaches a receiver.

SCORING A GOAL: Movement of the ball into the net 7 from any angle constitutes a goal and is worth one point. The distance value of the die bringing a ball into the goal net 7 may exceed the value necessary to enter the net. Only a ball carrier 24 and/or the ball 30 can enter the goal net 7, however, any playing piece on either team may be in the goalie box 8.

GOALKEEPER: A ball-carrying playing piece (called "ball carrier") may never carry the ball (dribble) directly over an opposing goalie when the goalie is in his goalie box 8. However, a goalie cannot stop a pass as long as there is a receiver. The ball or any playing piece with or without the ball may be moved over the offense's own goalkeeper just like any other playing piece. When a goalkeeper stands between the goal and the ball (with or without a ball carrier) attempting to enter the goal to score, the goalkeeper cannot be passed over except if the numerical value of the distance die is exactly equal to the value needed to get the ball into the goal net, i.e., one square past the end of the field. Only in this case may a shot on goal pass "over the goalkeeper's head".

SAVE BY GOALIE: If the ball (in possession or not) is in the goalkeeper's box 8, the goalkeeper may opt to defend the goal by trying a save. A save attempt constitutes a turn and is taken as follows:

The intention to attempt a save by the goalie must be announced before any dice are thrown, after which one die is thrown. The goalie can move in three straight lines in any three directions a total number of spaces equal to the number value on the die (or less if the ball is reached). For instance, if a 6 is thrown the goalie may move 4L, 1LB and 1SB for a total of six squares. The goalkeeper can move over any player during a save attempt as long as he lands on an empty square. If the ball is reached, a save is accomplished and the goalie takes possession of the ball. The playing piece losing possession is positioned five squares away from the ball in any direction in a straight line (standard defensive move). The goalie must immediately punt as follows.

PUNTING: All three dice are thrown. The ball moves by itself. The ball moves a distance equal to the value, or double the value, of one of the dice in any direction in a straight line. Then, the ball moves again, the value or double the value of a second die. Finally, the ball moves the value or double the value of the third and last die, in any direction in a straight line. If a ball reaches a receiver before the dice values are completely used up, it is possible to end the turn at that point.

In attempting a save, if a goalie does not reach and gain possession of the ball, the goalie may still use this move to block the ball's path of entry into the goal. This makes it necessary for the opponent to throw an exact value dice throw to enter the goal.

Note on Goal Keeping Strategy: Regrouping is another method by which a goalie may be moved to better position. In regrouping, the movement tends to be longer range, i.e., a greater number of squares, but less accurate. Three playing pieces, including the goalie, can be moved in regrouping. Also, on a "Save by Goalie" the opponent's ball carrier, or a free ball, can be tackled, but in regrouping, the ball and/or ball carrier cannot be tackled.

POSSESSION OF A FREE BALL: When the ball is not being carried by a player (not in possession), the first person reaching the ball gains possession of the ball as he reaches or crosses the square with the ball. If the square with the ball is reached or passed directly over by a playing piece, the playing piece moves into its destination square, then the ball is fastened to that playing piece, e.g., for a free ball which is three squares diagonally right forward of a playing piece and a 1, 6 and 2 are thrown, the 1 is used for direction (RF = Right Forward). The 6 is used for distance to move the playing piece directly over and past the free ball, landing six squares away from its original position. The ball is then put on that playing piece. The new ball carrier or any other playing piece can be moved right forward two more squares.

WHISTLE BLOWS: Three of the same numbers on the dice on a throw constitutes a WHISTLE BLOW and the calls by the referee are as follows:

THREE ONES, HAND BALL: The player throwing the three ones is given a free kick immediately because the opposing team "committed a hand ball foul". If the person throwing three ones already has possession of the ball, the free kick is taken from where the ball already is. If the other team has possession of the ball, or the ball is free, then the thrower is given possession of the ball by moving the player closest to the ball into the same space of the ball. If an opposing player loses possession of the ball in doing this, that player is allowed to immediately take the standard defensive position five spaces away from the ball before the free kick is performed. The free kick is taken as follows: Three dice are thrown. The ball is moved by itself in any three straight lines, as follows: The ball moves a distance equal to the value, or double the value, of one of the dice in any one direction in a straight line. Then, the ball moves again, the value or double the value of a second die in any one direction in a straight line. Finally, the ball moves the value or double the value of the third and last die in any one direction in a straight line. All three numerical values on the dice must be used except if a goal is scored or the ball reaches a receiver first. The playing piece taking the free kick cannot receive the ball itself, i.e., the free kick cannot travel in a loop and return to the kicker.

THREE TWOS, CORNER KICK: The corner kick is awarded to the player throwing three twos and is taken as follows: Any piece may be chosen and moved into either corner kick square in the opponent's half and given possession of the ball. All three dice are thrown and the ball is moved by itself in any one direction in a straight line, the value, or double the value, of one of the dice. Then the ball moves again, the value, or double the value, of a second die in any one direction in a straight line. Finally, the ball moves the value or double the value of the third and last die in any one direction, in a straight line. A goal may be scored on this move, or it can reach a receiver prior to using up the complete value of the dice.

ALL THREES, GOAL KICK: The thrower immediately takes any one of his playing pieces to one of the goal kick squares on his side of the board. This playing piece is given possession of the ball. The player then throws all three dice and the ball moves by itself in the same manner as a corner kick or free kick. (See THREE TWOS above.)

ALL FOURS, FORCED OUT OF BOUNDS: This whistle blow is unfortunate for the team currently in possession of the ball regardless of who throws the three fours. (NOTE: If neither team is in possession of the ball this whistle blow is ignored and the three fours are treated just for their numerical values of 4, 4 and 4 to determine direction and distance.)

The player possessing the ball immediately throws all three dice. The opposing player picks a single direction that the ball and ball carrier must move in a straight line. The distance is double the value of all three dice, and the play must force the ball carrier out of bounds (or it may not be used and the turn is ended).

The piece forced out of bounds is positioned on the red 14 or yellow area 16 just outside the playing field where it was forced out. A playing piece may not be forced into either goal net 7. Depending upon where the ball is forced out of bounds, one of three things happens next:

A. Out of Bounds over the Side Line

If the ball is forced out of bounds over the side line 16 then a THROW-IN is taken. Any player on the team newly in possession may be picked to carry the ball and gets the ball on the yellow square where the ball carrier was forced out of bounds. The piece losing possession takes the standard five- space-away defense (but not out of bounds). The player now carrying the ball may position any two additional pieces five squares away from these squares are not occupied (again, not out of bounds).

The throw-in is taken like an ordinary turn except that the ball moves by itself. A piece may only receive the thrown-in ball if the direction (determined exactly like an ordinary move) leads the ball directly to or over a receiver and the distance is equal to or greater than what is needed to get the ball to the receiver. If a piece receives the ball, he receives the ball on the square to which the ball would have traveled based on the distance rolled. No other player may move during a throw-in. The piece throwing the ball in moves back into the field, into the single space directly opposite his out-of-bounds position before the next move and resumes normal play.

If no one can receive the ball, the ball is given to the nearest opposing player, and the piece who attempted to do a throw-in is allowed to move back onto the field in the box adjacent to the spot where the throw-in was taken from. This ends the turn of the person attempting the throw-in.

B. Out of Bounds over a Goal Line

If the ball is forced out of play on the goal-line 14 then either a corner kick or goal kick is awarded against the team bringing the ball out of bounds.

GOAL/CORNER KICKS: If a ball carrier goes out of bounds across an offensive goal line, the other team is given a goal kick. A goal line is on the offensive side if it is on the side where the ball carrier is trying to score goals. If a player crosses a defensive goal line the other team is awarded a corner kick. A goal line is a defensive goal line if it is on the side where the ball carrier is trying to defend his goal.

ALL FIVES, SUPER DRIBBLE: The team of the thrower of three fives has a talented dribbler if this team is in possession of the ball when three dice are thrown. Each die represents a distance which may be doubled if desired. Each die also represents any one direction (straight line). Therefore, three dice represents three straight lines of travel. Each straight line equals the distance or double the distance of its respective die. This move is just like the punt, free kick, goal kick, or corner kick, except that the ball and ball carrying piece move together.

If three fives are thrown and the ball is not in possession by the dice thrower's team, the playing piece on the thrower's team closest to the ball is moved into the ball's square and given the ball. Any piece losing possession moves five squares away immediately. Then the "super dribble" is taken as described above.

THREE SIXES, BANANA SHOT PASS: If the thrower has possession of the ball, he can pass to any of his own players. If the thrower does not have possession, then the thrower simply chooses one of his playing pieces and the ball is brought to, and given to that playing piece. Essentially the player throwing three sixes gives the ball to any playing piece on his own team. This constitutes a turn.

NOTE: When dice are being thrown to carry out a whistle blow play it is not an ordinary turn, so throwing three-of-a-kind again has no special significance and the values of the dice are simply figured numerically to carry out the whistle blow instructions. Whistle blows can only occur on an ordinary turn. This is true of regrouping moves as well, whistle blows cannot occur during a regrouping dice throw.

The above-described soccer board game involves the use of strategy in deciding where and how to move on each player's turn. The ability to control the interaction of playing pieces and the ball requires additional decision making for both offensive and defensive moves, making this a challenging as well as amusing game.

It will be evident that there are additional embodiments which are not illustrated above but which are clearly within the scope and spirit of the present invention. The above description and drawings are therefore intended to be exemplary only and the scope of the invention is to be limited solely by the appended claims.

I claim:

1. A board game of soccer strategy for two players comprising:

a game board having a rectangular grid of individually identified squares, two goal areas at opposing ends of said board, and a plurality of areas indicated within said grid from which play is initiated;

a plurality of playing pieces for each said player for placement on squares of said grid, said plurality of playing pieces being identified as belonging to one player or the other;

a ball having a means for movement by said playing pieces and for scoring points by moving said ball into said goal areas;

at least three dice having numerical indication of a value of a throw of said dice; and at least one table for providing a correlation between said numerical indication of said dice and a direction of movement of said playing pieces.

2. A board game as in claim 1 wherein respective playing pieces of each said player have different colors for identification.

3. A board game as in claim 1 wherein each said playing piece has a means for removably retaining said ball so that movement of said playing piece constitutes movement of said ball.

4. A board game as in claim 1 wherein said game board simulates a soccer field having a goal net and a goalie box at each opposing end and a kick-off circle at a center of said field.

5. A board game as in claim 1 wherein one said at least one table is disposed at each end of said board.

* * * * *